US005515146A

United States Patent [19]

Harasawa et al.

[11] Patent Number: 5,515,146

[45] Date of Patent: May 7, 1996

[54] APPARATUS AND METHOD FOR CLEANING A BELT OF AN IMAGE FORMING APPARATUS

[75] Inventors: Yuko Harasawa, Kanagawa; Itaru Matsuta, Yokohama; Satoshi Takano; Hirokazu Ishii, both of Tokyo, all of Japan

[73] Assignee: Ricoh Company, Ltd., Tokyo, Japan

[21] Appl. No.: 429,904

[22] Filed: Apr. 27, 1995

[30] Foreign Application Priority Data

Jun. 29, 1994 [JP] Japan ..... 6-147706
Jan. 24, 1995 [JP] Japan ..... 7-009184

[51] Int. Cl.[6] ..... G03G 15/16

[52] U.S. Cl. ..... 355/271; 355/208; 355/274

[58] Field of Search ..... 355/271, 275, 355/277, 296, 208

[56] References Cited

U.S. PATENT DOCUMENTS 3,879,785 4/1975 Roth et al. .
4,533,236 8/1985 Garsin .
4,945,389 7/1990 Usui et al. .
5,175,584 12/1992 Usui .
5,189,479 2/1993 Matsuda et al. .
5,461,461 10/1995 Harasawa et al. ..... 355/208

FOREIGN PATENT DOCUMENTS 3-118582 5/1991 Japan .
3-125372 12/1991 Japan .
4-209145 7/1992 Japan .
5-333717 12/1993 Japan .
6-35340 2/1994 Japan .

*Primary Examiner*—Joan H. Pendegras
*Assistant Examiner*—Quana Grainger
*Attorney, Agent, or Firm*—Oblon, Spivak, McClelland, Maier & Neustadt

[57] ABSTRACT

An image forming device incorporated in an image forming apparatus and capable of cleaning a residual toner on a transfer belt. A transfer belt transports a sheet to a nip portion of an image carrier and the transfer belt. A transfer bias current It1 is applied to the transfer belt from a power source, so that a toner image on the image carrier is transferred to the sheet at the nip portion. A cleaning bias current It2 is applied to a cleaning bias roller which is held in contact with the transfer belt so as to transfer the residual toner and paper particles from the transfer belt to the cleaning bias roller. An electric current Ir is returned from the transfer belt to a transfer control board which is also connected to the power source. The transfer control board controls the current It1 to satisfy an equation "(It1+It2)–Ir= IOUT" where IOUT is constant.

26 Claims, 7 Drawing Sheets

APPARATUS AND METHOD FOR CLEANING A BELT OF AN IMAGE FORMING APPARATUS

BACKGROUND OF THE INVENTION

1. Field of the Invention

The present invention relates to an image transferring device for an image forming apparatus such as a copier, printer, facsimile machine or similar photographic image forming apparatus in which an image is formed on a photoconductive element. More particularly, the invention is concerned with an image transferring device for transferring a toner image from the photoconductive element to a sheet of paper which is carried on a transfer belt. The present invention further relates to a method and apparatus for electrically cleaning the transfer belt.

2. Description of the Related Art

It is a common practice for an image forming apparatus of the kind described above to use either a corona discharge type image transferring device or a contact type image transferring device. The corona discharge type device transfers a toner image formed on a photoconductive element to a sheet of paper by effecting corona discharge at the rear of the sheet. The contact type device transfers a toner image from a photoconductive element to a sheet carried on a transfer belt to which an electric field opposite in polarity to the toner image is applied.

The contact type image transferring device usually includes an arrangement for applying a transfer bias to the transfer belt. For example, an electrode is connected to a power source and held in contact with the rear of the belt at an image transfer position. Such an arrangement is advantageous over one using corona discharge, since it does not produce harmful ozone and can operate with a low voltage while reducing the size and cost of the device.

Japanese Laid-Open Publication NO. 5-333717 discloses an image transfer device using a contact electrode as shown in FIG. 12. Referring to FIG. 12, a transfer belt 8 is wound around a driven roller 3 and a drive roller 9, the rollers both being formed of conductive materials. A photoconductive drum 1 is disposed above the transfer belt 8. A conductive bias roller 5 and contact plate 7 are held in contact with the inner surface of transfer belt 8. The bias roller 5 is connected to a power source 18 and is also used as a contact electrode. The transfer belt 8 is made of a dielectric material and has a double layer structure, i.e., a surface or outside layer and an inner layer. The surface layer has an electric resistance of $1\times10^{9}$ Ω to $1\times10^{12}$ Ω and the inner layer has an electric resistance of $1\times10^{7}$ Ω to $1\times10^{9}$ Ω. A lever 4 which is driven by a DC solenoid 6 is located under the transfer belt 8. A cleaning blade 11 rubs a surface of the transfer belt 8 and removes residual toner on the transfer belt 8. A toner container 13 and a coil 12 which transports toner to a toner collection container (not shown) are located under the blade 11.

A sheet of paper P is transported to a nip position B between the photoconductive drum 2 and the transfer belt 8 by a pair of a resister rollers 1. At this time the DC solenoid 6 moves the lever 4 which moves the transfer belt 8 toward the photoconductive drum 2 so that the transfer belt 8 is held in contact with the photoconductive drum 2. A transfer bias is applied to the transfer belt via a bias roller 5 so that a toner image is transferred to the sheet of paper P at the nip position B. An electric charge is added to the transfer belt 8 and the sheet of paper P is discharged via a contact plate 7 through the transfer belt 8.

In this case, assuming that an output current from a power source 18 is I1, and a feedback current from the contact plate 7 to a transfer control board 20 is I2. The current I1 is controlled by the transfer control board 20 to satisfy an equation:

$$I1-I2=\mathrm{IOUT}$$

where IOUT is constant.

After the toner image is transferred to the sheet of paper P, the electric charge of the sheet P is discharged gradually by the contact plate 7 via the transfer belt 8 to a ground. Then the sheet of paper P is separated from the transfer belt 8 at the position of the drive roller 9. After the sheet of paper P is separated from the transfer belt 8, the lever 4 is released to separate the transfer belt 8 from the photoconductive drum 2.

After the sheet of paper P is separated from the transfer belt 8, the surface of the transfer belt 8 is cleaned by a cleaning blade 11. The cleaning blade 11 rubs the surface of the transfer belt 8 to scrape off the toner transferred from the background of the photoconductive drum 2 to the transfer belt 8, the toner scattered around the transfer belt 8 without being transferred, and paper dust generated from the sheet of paper P. The toner and paper dust removed from the transfer belt 8 by the blade 11 are collected in a waste toner container (not shown). For this reason, it is required that a coefficient of friction μ between the surface of the transfer belt 8 and the cleaning blade 11 be small (0.5 or less) and that there are no cracks on the surface of the transfer belt 8. If the coefficient μ is large, it will cause some inconvenience such as an increase in the driving load torque of the transfer belt 8 or a bending of the cleaning blade 11.

After a period of time in the above mentioned transfer device, the frictional coefficient μ of the surface of the transfer belt 8 increases, and cracks form on the surface of the transfer belt 8 due to friction between the surface of the transfer belt 8 and the cleaning blade 11. Then, the toner and paper dust cannot be removed from the surface of the transfer belt 8 by the cleaning blade 11. As a result, the reverse side of the sheet P will become dirty and the sheet P cannot always be properly separated from the photoconductive drum 2.

Japanese Patent Laid-Open Publication No. 3-125372 discloses a bias cleaning device which cleans a residual toner from a transfer belt. This cleaning device can work only when the transfer belt is away from the photoconductive drum in order to prevent an electrical charge from the cleaning bias roller from having a bad effect on the transfer of a toner image to a sheet of paper. Since this device acts only when the transfer belt is away from the photoconductive drum, toner remains on the transfer belt when the sheets are fed successively.

SUMMARY OF THE INVENTION

According to one object of this invention is to provide a novel image transferring device for an image forming apparatus which can solve the aforementioned conventional drawbacks. A further object of the present invention is to provide an image transferring device for an image forming apparatus in which the cleaning aspect can be performed during an image transfer.

In order to achieve the above-mentioned objects, according to the present invention, a device for transferring an image formed on an image carrier to a sheet includes a transfer belt movable into contact with an outer periphery of the image carrier, a first electrode held in contact with the transfer belt which applies current in order to transfer an image to a sheet of paper, a cleaning electrode held in contact with the transfer belt, a power source applying current to the first electrode and the cleaning electrode, and at least one contact member held in contact with the transfer belt. The current flows from the first and cleaning electrodes through the transfer belt to the contact member. A transfer control board has an input connected to the contact member and output connected to the power source so as to control the output of the power source. Other objects and aspects of the present invention will become apparent herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
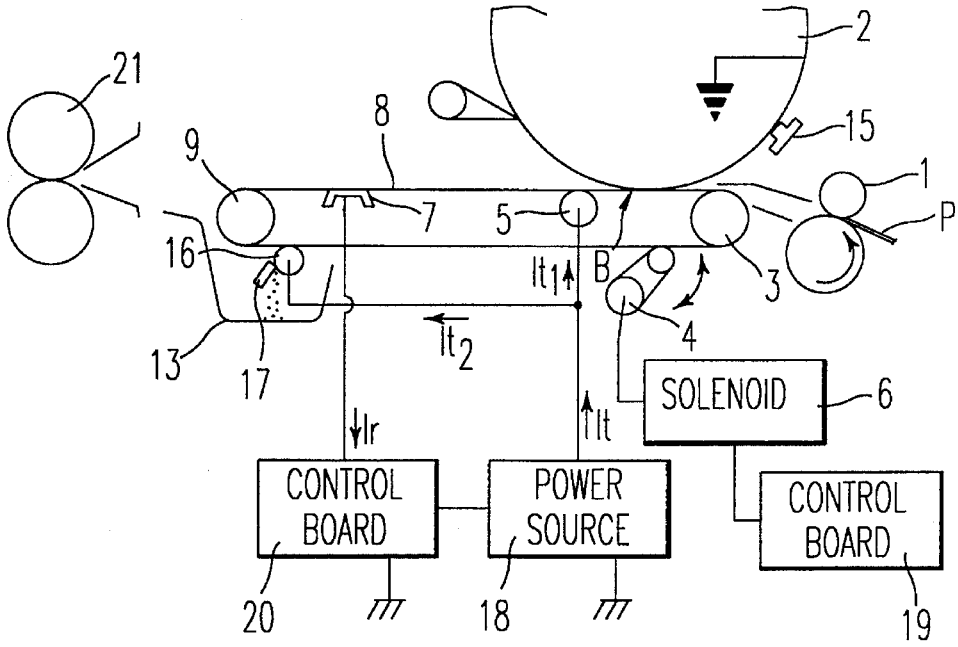
FIG. 1 is a schematic representation showing the general construction of an image transferring device embodying the present invention.

Referring now to the drawings, wherein like reference numerals designate identical or corresponding parts throughout the several views, and more particularly to FIG. 1 thereof, an image transferring device for an image forming apparatus embodying the present invention is shown. As shown, an image forming apparatus 10 has a rotatable photoconductive drum 2. The apparatus has a discharger 15 which discharges an electric charge on the photoconductive drum 2. The apparatus also has the following elements (not illustrated) which may be conventional and disposed around the drum: a charger which charges the photoconductive drum 2, an exposing device which forms a latent image on the photoconductive drum 2, a developing device which develops the latent image and a cleaning device which cleans residual toner on the photoconductive drum 2.

A transfer belt 8 is located under the photoconductive drum 2. The transfer belt 8 is supported by a drive roller 9 and a driven roller 3. An electric conductive bias roller 5 which applies a transfer bias voltage to the transfer belt 8 and an electric conductive contact plate 7 which detects feedback current from the transfer belt 8 are held in contact with the inside of the transfer belt 8. Resister rollers 1 are located upstream of the nip portion B between the photoconductive drum 2 and the transfer belt 8. The contact plate 7 is located downstream of the nip portion B with respect to a moving direction of the transfer belt 8. The transfer belt 8 is made of a dielectric material and has a double layer structure, i.e., an outer or surface layer and an inner layer. The surface layer has an electric resistance of $1\times10^{9}\ \Omega$ to $1\times10^{12}\ \Omega$, and the inner layer has an electric resistance of $1\times10^{7\ \Omega\ to}$ $1\times10^{9}\ \Omega$. The bias roller 5 is connected to a power source 18.

A lever 4 which is driven by a DC solenoid 6 is located under the photoconductive belt 8. The solenoid 6 is controlled by a control signal from a control board 19 and it drives the lever 4 so as to move the transfer belt 8 toward and away from the photoconductive drum 2. A cleaning bias roller 16 is held in contact with the transfer belt 8 near the drive roller 9. The cleaning bias roller 16 is connected to the power source 18 and attracts residual toner from the transfer belt 8. A blade 17 is held in contact with the surface of the cleaning bias roller 16. A waste toner container 13 is located under the blade 17. A fuser device 21 is located downstream of the transfer belt 8 with respect to a paper feed direction.

Figure 2:
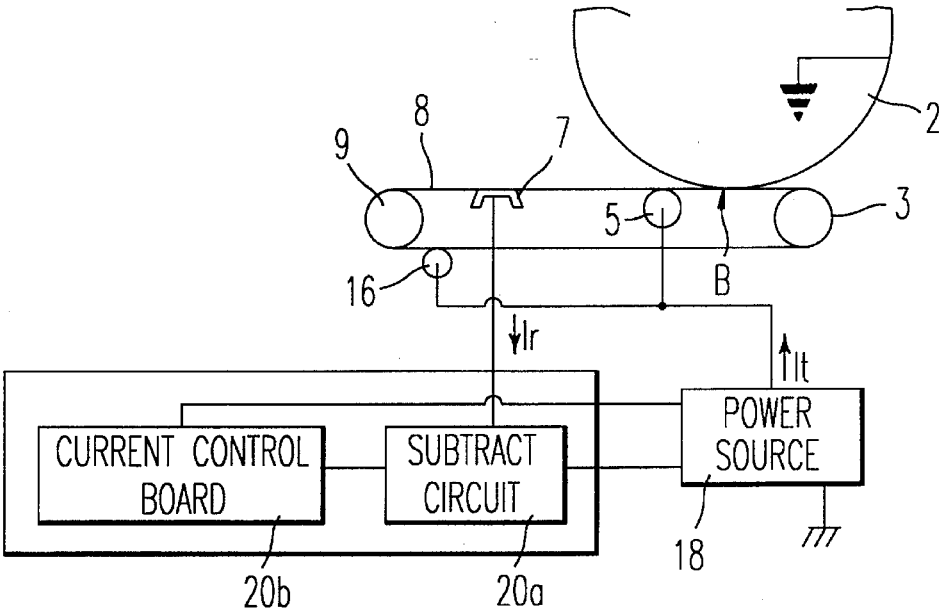
FIG. 2 shows a block diagram of a transfer control board of FIG. 1.

Referring to FIG. 1 and FIG. 2, a transfer control board 20 is connected between the contact plate 7 and the power source 18. The control board 20 includes a subtract circuit 20*a* and a current control circuit 20*b*. The subtract circuit 20*a* calculates $$It-Ir=IOUT \tag{1}$$

where It is an output current from the power source 18, and Ir is a feedback current from the contact plate to the control board 20. The current control circuit 20*b* controls the current It to keep the current IOUT a constant value. IOUT represents current which is not a part of Ir and does not flow through the contact plate 7 but flows through other components of the system such as the photoconductive drum 2.

In operation, a sheet of paper P which has already reached the resister rollers 1 is fed between the photoconductive drum 2 and the transfer belt 8 by the resister rollers 1. At this time, the lever 4 contacts the transfer belt 8 with the photoconductive drum 2 under an exciting action of the DC solenoid 6. On the other hand, the surface of the photoconductive drum 2 is charged and carries a toner thereon. Before the sheet of paper P reaches the nip portion B, the transfer bias is applied to the transfer belt 8 via the bias roller 5, so that a minus electric field opposite in polarity to the polarity of the toner is applied to the transfer belt 8. Then the toner image on the photoconductive drum 2 is transferred to the sheet of paper P which is transported by the transfer belt 8 at the nip portion B. The current It which is the output current of the power source 18 is the sum of the current It1 and the current It2, where It1 is the current which is applied from the power source 18 to the transfer belt 8 via the bias roller 5, and It2 is the current which is applied from the power source 18 to the transfer belt 8 via the cleaning bias roller 16. The transfer control board 20 controls the current It to satisfy equation 1 which states It–Ir=IOUT where It=It1+It2.

For example, a transfer bias voltage is 4 kV, where the resistance of the transfer belt 8 is 1×10 Ω, the temperature is 23 C., the humidity is 65 percent, and IOUT is 45 μA. Under this condition, the most suitable electric field for the transfer is formed at the nip portion B, and the voltage of 4 kV is applied from the power source 18 to the cleaning bias roller 16.

In the present invention, the dirty toner of the background of the photoconductive drum 2 and the scattered toner is transferred or adhered to the surface of the transfer belt 8. The toner is then charged to a positive polarity by the contact plate 7. The residual toner on the surface of the transfer belt 8 is subsequently transferred to the cleaning bias roller 16 by a potential which is formed between the transfer belt 8 and the cleaning bias roller 16, so that the residual toner on the surface of the transfer belt 8 is cleaned.

As mentioned above, the transfer current is controlled including the current It2, so that the electric field which is formed by the cleaning bias roller 16 does not influence the electric field used for transferring. As a result, the electric field of the nip portion B is kept constant, and the residual toner on the transfer belt 8 is well cleaned. After transferring the toner image from the photoconductive drum 2 to the sheet of paper P, the transfer belt 8 continues to move as it carries the sheet of paper P. The sheet of paper P is separated from the transfer belt 8 at the drive roller 9. The sheet of paper P is fed to the fixing device 21, and the toner image is fixed on the sheet of paper P.

Next, it will be explained how the electric field at the nip portion B is kept constant. Theoretically, the efficiency of transfer is determined by an electric field of a vacant space. Assume that an amount of an electric charge for transferring on the sheet of paper is σc, the electric field of a vacant space is ϵ, the transfer current is It–Ir, a dielectric constant in a vacuum is $\epsilon_0$, a feeding velocity of a sheet of paper is v, and a width of the transfer belt is L. These parameters satisfy the following equation:

$$\sigma c=\epsilon_0 E=(It-Ir)/vL \quad (2).$$

Therefore if the velocity v and the width L are constant, the efficiency of transfer is determined by the transfer current (It–Ir). That is to say, by controlling the current which flows from the transfer belt 8 to the photoconductive drum 2 to be constant, the toner image is transferred stably regardless of the thickness and type of the sheet of paper and a change of a resistance caused by an environmental condition.

The polarity of the cleaning bias voltage is the same as that of the transfer bias voltage. The transfer belt 8 has a medium range resistance, so that the electric charge to the nip portion B is applied from the bias roller 5 and the cleaning bias roller 16. As shown in FIG. 1, the output current It from the power source 18 is applied to both of the bias roller 5 and the cleaning bias roller 16. The current It1 which is applied to the bias roller 5 flows to the contact plate 7 and also through the transfer belt 8 into ground through the photoconductive drum 2 via the nip portion B. The current It2 which is applied to the cleaning bias roller 16 flows to the contact plate 7 and also through the transfer belt 8 into ground through the photoconductive drum 2 via the nip portion B. Therefore, in order to apply constant current to the nip portion B, the difference IOUT between the current It which is applied to the transfer belt 8 and the current Ir which flows into the transfer control board 20 via the belt 8 is controlled to be a constant value.

Figure 3:
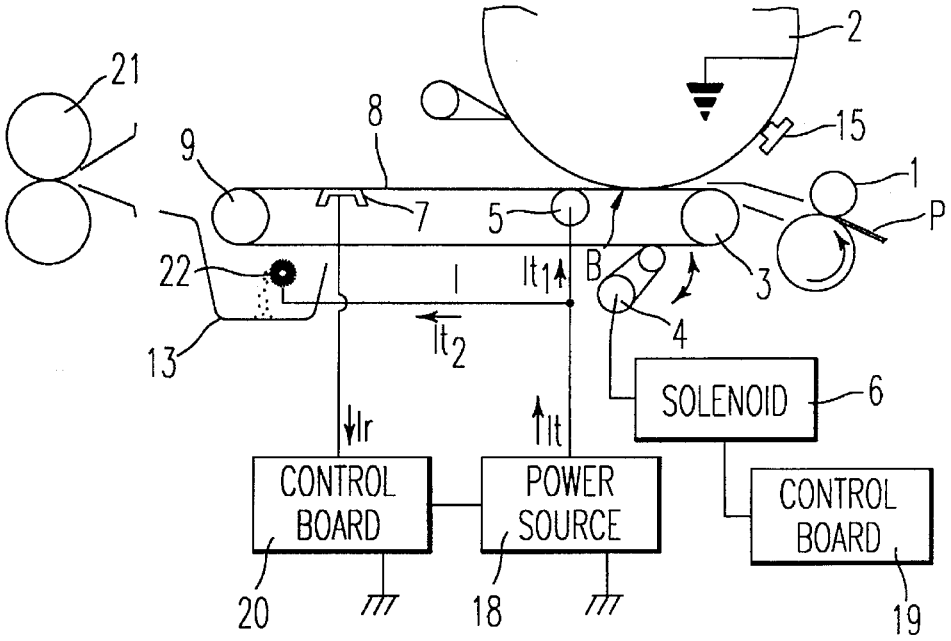
FIG. 3 is a schematic representation showing a modified embodiment of the cleaning member of FIG. 1.

FIG. 3 shows a modified embodiment of the present invention. Referring to FIG. 3, a cleaning bias brush 22 is used instead of the cleaning bias roller 16 of FIG. 1. In this embodiment, the blade 17 held in contact with the cleaning bias roller 16 of FIG. 1 is not needed because the brush 22 which rotates and rubs the surface of the belt 8 scrapes the residual toner off the transfer belt 8 and directly drops the toner in the waste toner container 13.

Figure 4:
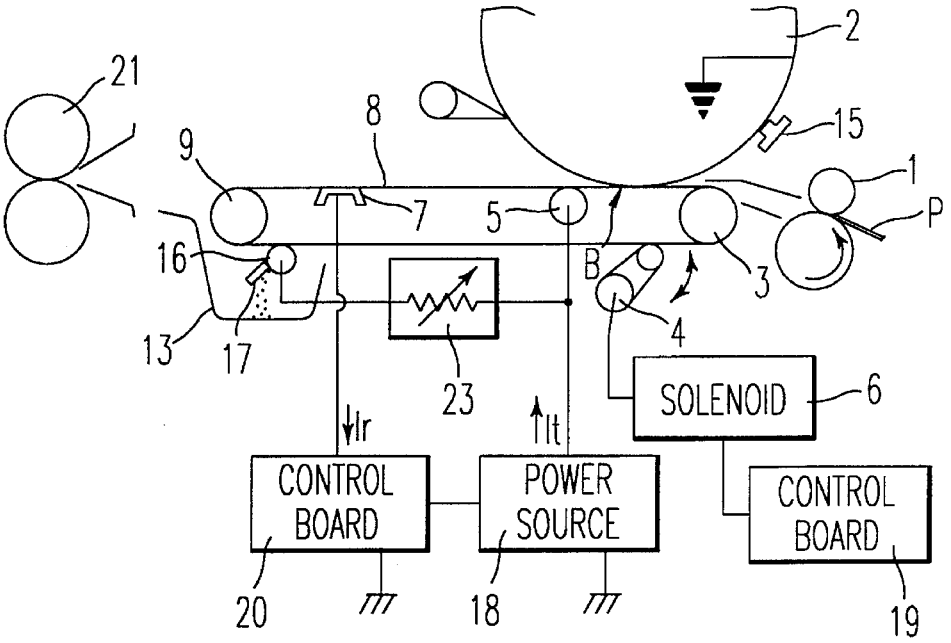
FIG. 4 is a schematic representation showing the general construction of an image transferring device which uses a variable resistance.

FIG. 4 shows a third embodiment of the present invention. Referring to FIG. 4, a variable resistor 23 is provided between the cleaning bias roller 16 and the power source 18. The variable resistor 23 is connected to and the resistance thereof is controlled by the transfer control board 20. Also, the transfer control board 20 controls the current It to satisfy the above described equation 1 which states It–Ir=IOUT, where Ir is the feedback current from the contact plate 7 to the transfer control board 20, and IOUT is constant.

For example, the transfer bias voltage is 5.5 kV, where the resistance of the transfer belt 8 is $1\times10^8$ Ω, the temperature is 10° C. the humidity is 15 percent and IOUT is 45 μA. In this condition, the most suitable electric field for the transfer is formed at the nip portion B, and the voltage of 5.5 kV is applied from the power source 18 to the cleaning bias roller 16. However, the voltage of 5.5 kV is too high for cleaning, so that the efficiency of the cleaning may decline. Since the cleaning bias roller 16 is held in direct contact with toner on the belt 8, if a high voltage is applied to the roller 16, an electric charge is applied to the toner. Therefore not more than 4 kV is applied to the cleaning bias roller 16 by means of variable resistor 23 to lower the voltage. That is to say, the output voltage of the power source 18 is detected by the transfer control board 20. The detected voltage is then fed to the variable resister 23. The electric resistance of the variable resistor 23 is controlled in response to the detected value so as to control the voltage applied to the cleaning bias roller to be not more than 4 kV.

Figure 5:
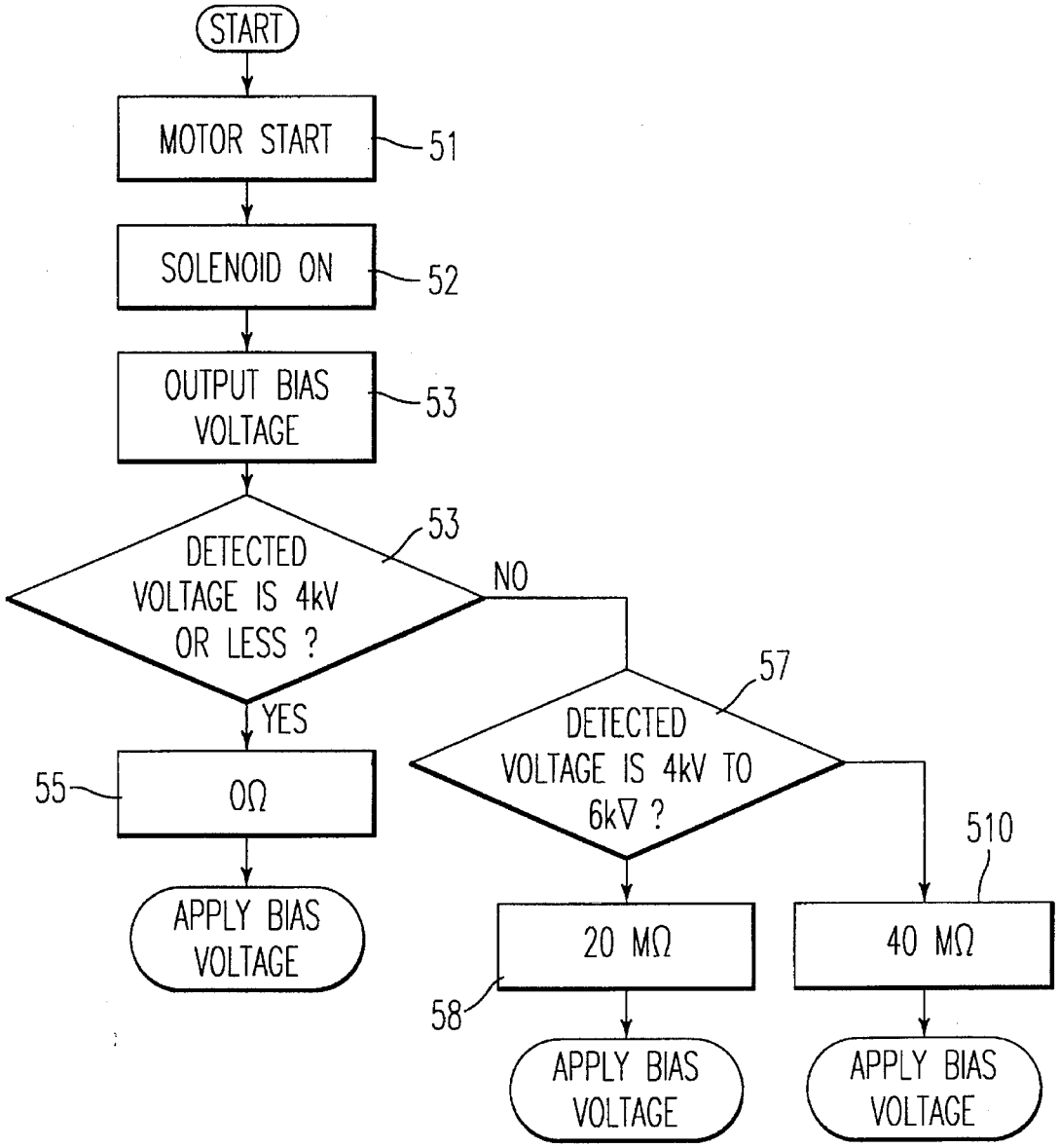
FIG. 5 is a flowchart showing a control processing of the variable resistance of FIG. 4.

FIG. 5 shows a control process used with the variable resistor. Referring to FIG. 5, in step 51 the motor starts to move the transfer belt 8, and in step 52 the solenoid 6 is driven. In step 53 the power source 18 outputs the bias voltage. The bias voltage is detected by the transfer control board 20. In steps 54 and 57 the detected voltage and a predetermined value are compared with each other. In step 54, if the detected voltage is 4 kV or less, step 55 sets an electric resistance of the variable resistor 23 to near 0 Ω. In step 57 if the detected voltage is 4 kV to 6 kV, step 58 sets the electric resistance of the variable resistor 23 to 20M Ω. In step 57, if the detected voltage is more than 6 kV, step 510 sets the electric resistance of the variable resistor 23 to 40M Ω. After the variable resistor 23 is controlled, the cleaning bias voltage is applied to the cleaning bias roller 16. Then, the residual toner on the transfer belt 8 is transferred to the cleaning bias roller 16 so that the toner on the transfer belt 8 is removed.

Figure 6:
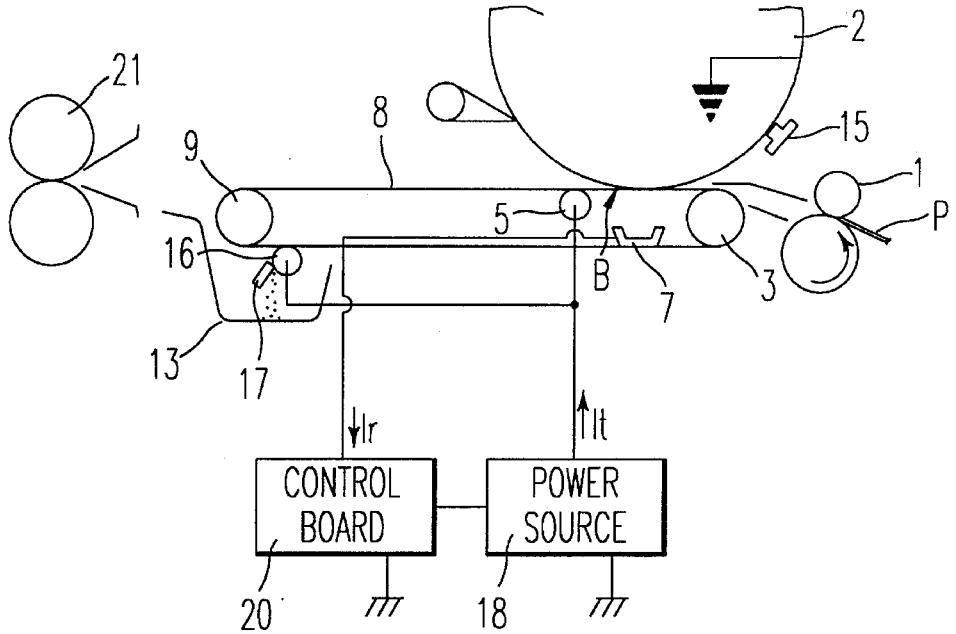
FIG. 6 is a schematic representation showing a modified embodiment of a contact member of FIG. 1.

FIG. 6 shows a modified embodiment of FIG. 1. Referring to FIG. 6, the contact plate 7 is located upstream of the nip portion B with respect to the moving direction of the transfer belt 8. Since the contact plate is located upstream of the nip portion B, most current which is applied from the cleaning bias roller 16 to the transfer belt 8 is discharged via the contact plate 7 without flowing through the nip portion B. Therefore the bias current for cleaning does not affect the transfer upstream of the nip portion B.

Figure 7:
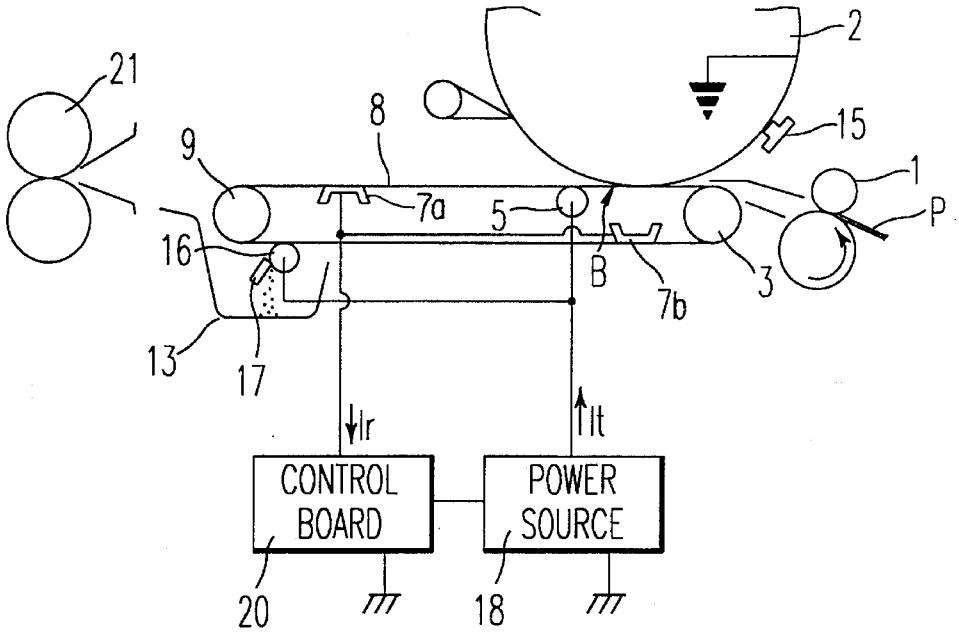
FIG. 7 is a schematic representation showing the second modified embodiment of the contact member of FIG. 1.

FIG. 7 shows the second modified embodiment with respect to location of the contact plate of FIG. 1. Referring to FIG. 7, the contact plate 7*a* is located downstream of the nip portion B and the contact plate 7*b* is located upstream of the nip portion B. In this embodiment, most current which is applied from the cleaning bias roller 16 to the transfer belt 8 is discharged via the contact plates 7*a* and 7*b* without flowing through the nip portion B. Therefore the bias current for cleaning does not affect the transfer.

Figure 8:
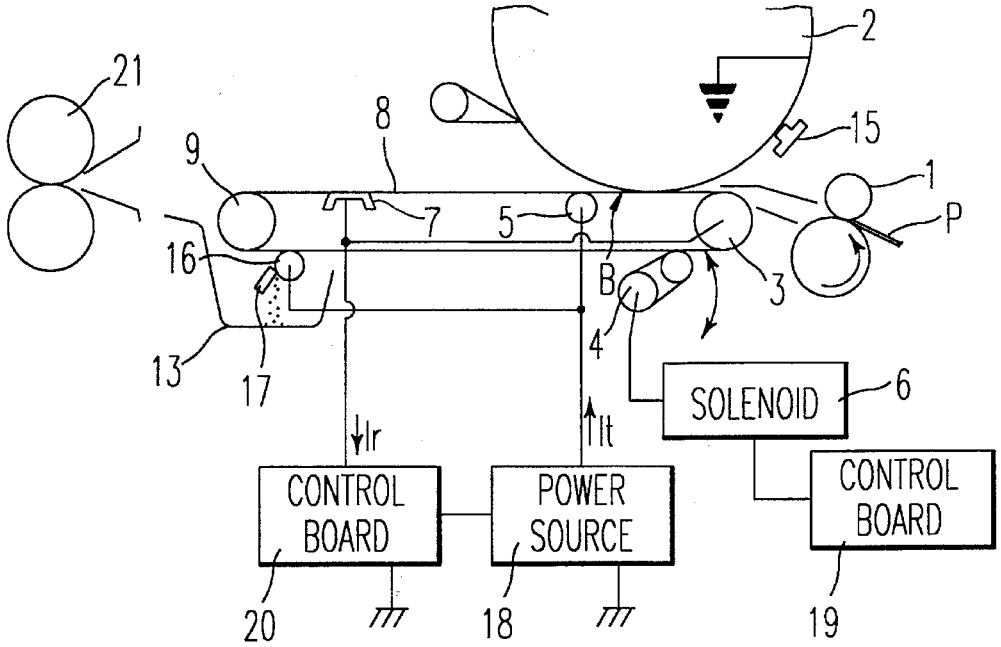
FIG. 8 is a schematic representation showing the third modified embodiment of the contact member of FIG. 1.

FIG. 8 shows the third modified embodiment of the invention. The driven roller 3 which is an electric conductive roller is also used to receive the feedback current instead of the contact plate 7*b* of FIG. 7. In this structure, the feedback current is returned from the plate 7*a* and the driven roller 3 to the transfer control board 20. As another structure, the drive roller 9 is also usable to receive feedback current instead of the driven roller 3 or the drive roller may be used together with the driven roller 3.

Figure 9:
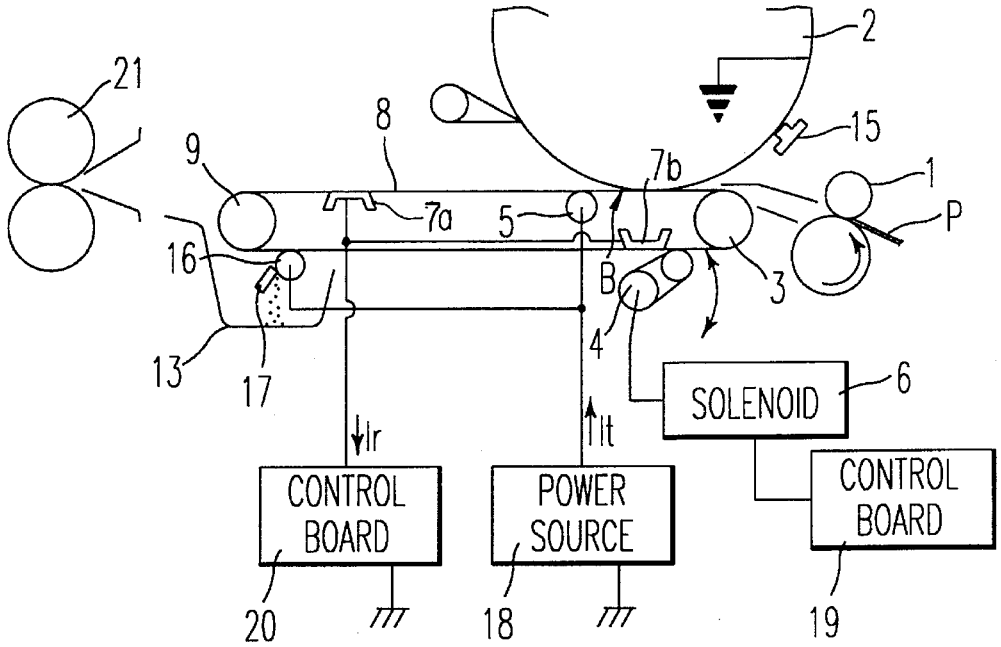
FIG. 9 is a schematic representation showing a modified embodiment in which a fixed resistance is used instead of the variable resistance of FIG. 4.

FIG. 9 shows a modified embodiment for controlling the voltage applied to the cleaning bias roller 16 so as to be a predetermined voltage. Referring to FIG. 9, a resistor 24 is connected between the power source 18 and the cleaning bias roller 16. The resistor 24 controls the applied voltage to the cleaning bias roller 16 at a suitable voltage for cleaning.

Figure 10:
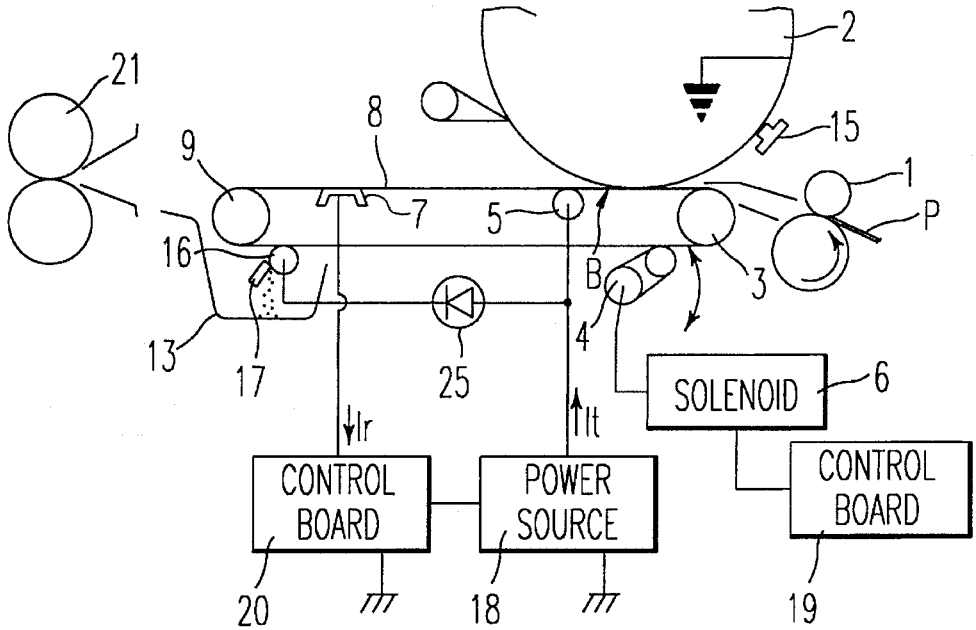
FIG. 10 is a schematic representation showing a modified embodiment in which a diode is used instead of the fixed resistance of FIG. 9.

As shown in FIG. 10, a diode 25 is also usable for controlling the applied voltage to the cleaning bias roller 16 to a suitable voltage instead of the resister 24 of FIG. 9.

Figure 11:
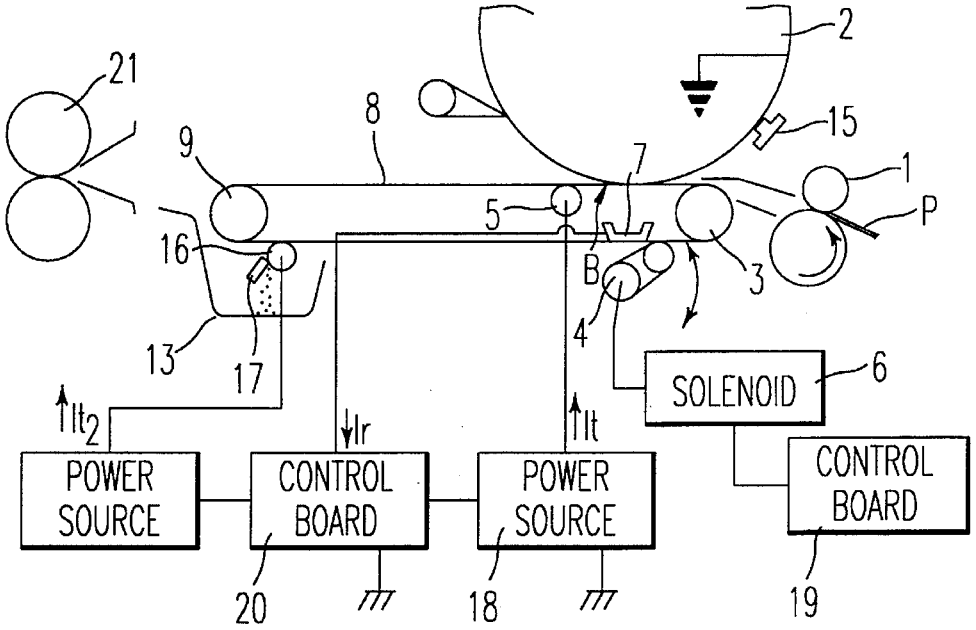
FIG. 11 is a schematic representation showing the modified embodiment in which two power sources are used.
Figure 12:
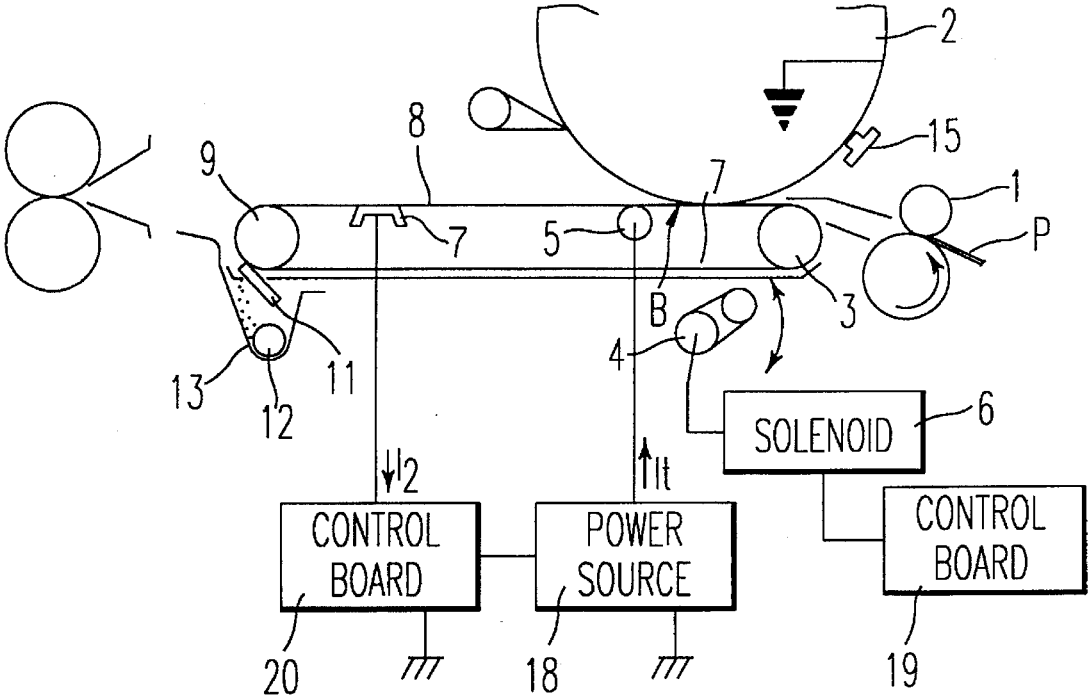
FIG. 12 PRIOR ART
FIG. 12 is a schematic representation showing the general construction of a conventional image transferring device.

FIG. 11 shows a structure using two power sources; one is for transferring and the other is for cleaning. Referring to FIG. 11, the power source 18 is connected to the bias roller 5 and the transfer control board 20. In this embodiment, a power source 26 is connected to the cleaning bias roller 16 and the transfer control board 20. The bias current It1 is applied to the bias roller 5 from the power source 18, and the cleaning bias current It2 is applied to the cleaning bias roller 16 from the power source 25. The transfer control board 20 controls the current It1 so as to satisfy the equation (It1+It2)−Ir=IOUT, where IOUT is constant. As for controlling the current, it is also possible to control the current It2 instead of the current It1. Since if the current It2 is controlled to increase as a result of controlling the current It1, an electric charge is applied the toner, controlling the current It1 is preferable to controlling the current It2. Furthermore, control of the current It2 has a lower efficiency of response for transferring the current than control of the current It1. Therefore control of the current It1 is suitable for both of transferring and cleaning.

The power source 25 is not only for the use of cleaning only but also for the use of other process members as well.

According to the present embodiment, the bias cleaning device is usable for an image transferring device. Furthermore, various transfer belts are usable, even if the surface of the belt is rough and a frictional coefficient of the surface of the belt is high. Further, a coating on the surface of the belt and treating the surface with chemicals in order to reduce a coefficient of friction between the belt and a cleaning blade are not required as it is not necessary to use a cleaning blade. It is also possible for the cleaning blade to have a single layer structure instead of a double layer structure.

It is to be noted that the rollers, contact plate, and cleaning bias brush are each electrically connected between the power source or control board and the transfer belt and are considered to be electrical contacts. Further, even though the electrical contact 7 is not illustrated as being directly connected to the power source, it is of course necessary for the contact 7 to be connected in some manner to the power source such as through a grounding connection.

The present invention uses various control boards including a current control board and a subtract circuit to perform the described functions. These boards and circuits may be implemented using a conventional microprocessor or conventional general purpose digital computer programmed according to the teachings of the present specification, as will be appropriate to those skilled in the art. Appropriate software coding can readily be prepared by skilled programmers based on the teachings of the present disclosure, as will be apparent to those skilled in the software art. The invention may also be implemented by the preparation of applications specific integrated circuits or by interconnecting an appropriate network of conventional component circuits, as will be readily apparent to those skilled in the art.

Obviously, numerous modification and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for transferring an image formed on an image carrier to a sheet, comprising:

a transfer belt movable into contact with an outer periphery of said image carrier;

a first electrical contact which electrically contacts the transfer belt;

a second electrical contact, different from the first electrical contact, which electrically contacts the transfer belt;

a third electrical contact, different from the first and second electrical contacts, which electrically contacts the transfer belt;

a power source electrically connected to the first, second and third contacts; and a controller, connected to the power source, which controls an attraction of particles from the transfer belt to the third electrical contact by controlling an electrical signal applied from said power source to at least one of said first and third electrical contacts using electrical feedback from the second electrical contact such that the particles on the transfer belt are electrically attracted off of the transfer belt to the third electrical contact due to a voltage applied to the third electrical contact.

2. A device as claimed in claim 1, wherein:

said first electrical contact electrically contacts the transfer belt at a position proximate to the image carrier and supplies a charge to the sheet when the sheet is on the transfer belt in order to attract an image on the image carrier to the image transfer belt; and said third electrical contact electrically conducts the particles off of the transfer belt at a same time as the charge is being supplied to the sheet from the first electrical contact.

3. A device as claimed in claim 1, wherein:

a voltage applied to the first electrical contact has a same potential as a voltage applied to the third electrical contact.

4. A device as claimed in claim 1, wherein:

a voltage applied to the first and third electrical contacts is opposite in polarity to a voltage applied to the second electrical contact.

5. A device as claimed in claim 1, wherein said third electrical contact is positioned downstream, relative to a sheet feed direction, of a position on said transfer belt at which the sheet is separated from the transfer belt.

6. A device as claimed in claim 1, wherein the third electrical contact is a conductive roller.

7. A device according to claim 6, further comprising a cleaning blade contacting the conductive roller.

8. A device as claimed in claim 1, wherein said third electrical contact is a conductive brush.

9. A device as claimed in claim 1, wherein said power source is a single power source and outputs current to said first electrical contact and said third electrical contact.

10. A device as claimed in claim 9, wherein said controller controls the power source to output a current It which satisfies an equation:

$$It-Ir=IOUT$$

where:

It is a sum of currents flowing into the first and third electrical contacts,

Ir is the electrical feedback flowing from said second electrical contact; and

IOUT is constant.

11. A device as claimed in claim 1, wherein said power sources comprises two power sources, a first power source connected to said first electrical contact and a second power source connected to said third electrical contact.

12. A device as claimed in claim 11, wherein said controller controls said first and second power sources to satisfy an equation:

$$(It1+It2)-Ir=IOUT$$

where:

It1 is an amount of current flowing to the first electrical contact,

It2 is an amount of current flowing to the third electrical contact,

Ir is the electrical feedback flowing into said controller from said second electrical contact; and IOUT is constant.

13. A device as claimed in claim 12, wherein the controller controls the current It1.

14. A device as claimed in claim 12, wherein the controller controls the current It2.

15. A device as claimed in claim 1, wherein a position where said second electrical contact electrically contacts the transfer belt is upstream of a nip portion between said image carrier and said transfer belt with respect to a moving direction of said transfer belt.

16. A device as claimed in claim 1, wherein a position where said second electrical contact electrically contacts the transfer belt is downstream of a nip portion between said image carrier and said transfer belt with respect to a moving direction of said transfer belt.

17. A device as claimed in claim 1, wherein said second electrical contact includes two electrical contacts, a position where a first of said second electrical contacts electrically contacts the transfer belt is downstream of a nip portion between said image carrier and said transfer belt with respect to a moving direction of said transfer belt, and a position where a second of said second electrical contacts electrically contacts the transfer belt is upstream of a nip portion between said image carrier and said transfer belt with respect to a moving direction of said transfer belt.

18. A device as claimed in claim 1, wherein said first electrical contact is a roller which supports the transfer belt proximate to a position where the sheet contacts the image carrier.

19. A device as claimed in claim 1, further comprising a resistance connected between said power source and said third electrical contact.

20. A device as claimed in claim 19, wherein said resistance is a variable resistance controlled by said controller.

21. A device as claimed in claim 1, further comprising a diode connected between said power source and said third electrical contact.

22. A device as claimed in claim 1, wherein said transfer belt is a single layer belt.

23. A device for transferring an image formed on an image carrier to a sheet, comprising:

a transfer belt movable into contact with an outer periphery of said image carrier;

a power source;

charging means, connected to the power source, for charging said transfer belt so that an image on the image carrier is attracted to the sheet while the sheet is on the transfer belt at a position proximate to the charging means;

attracting means, connected to the power source and different from the charging means, for attracting particles off of the transfer belt;

feedback means for feeding back an electrical state of said transfer belt; and control means, connected to the power source and the feedback means, for controlling the attracting means by controlling an electrical signal applied from said power source to at least one of said charging means and attracting means using electrical feedback from the feedback means such that the particles on the transfer belt are electrically attracted off of the transfer belt to the attracting means due to a voltage applied to the attracting means.

24. A device as claimed in claim 23, wherein:

said control means controls the power source to output a current It which satisfies an equation:

$$It-Ir=IOUT$$

where:

It is a sum of currents flowing into the charging means and attracting means;

Ir is current flowing into said controller from said feedback means; and

IOUT is constant.

25. A method for cleaning particles from a transfer belt of an image forming apparatus, comprising the steps of:

applying a first voltage to a first portion of the transfer belt;

applying a voltage having a same polarity as the first voltage to a cleaning member in contact with a third portion of the transfer belt and cleaning the particles off of said transfer belt by transferring the particles to the cleaning member due to the voltage applied thereto;

feeding back an electrical state of a second portion of the transfer belt;

controlling a cleaning action by the cleaning member by controlling at least one of the voltages applied the first portion and third portion of the electrical belt using the electrical state of the second portion of the belt.

26. A method according to claim 25, wherein:

said first voltage applied to the first portion of the transfer belt attracts an image on an image carrier to a sheet; and the voltage applied to the cleaning member is applied at a same time as the first voltage is applied to the first portion of the transfer belt.

* * * * *